US006516700B1

(12) United States Patent
Nikonov et al.

(10) Patent No.: US 6,516,700 B1
(45) **Date of Patent: *Feb. 11, 2003**

(54) AUTOMATIC WEAPON

(75) Inventors: Gennady Nikolaevich Nikonov, Izhevsk (RU); Azary Ivanovich Nesterov, Izhevsk (RU); Vladimir Vladimirovich Abramyan, Izhevsk (RU); Alexandr Sergeevich Anisimov, Izhevsk (RU); Valery Pavlovich Afonin, Izhevsk (RU); Alexandr Nikolaevich Turkin, Izhevsk (RU); Vladimir Alexeevich Tsypko, Izhevsk (RU)

(73) Assignees: Otkrytoe Aktsionernoe Obschestvo"Izhmash", Izhevsk (RU); Ruspa-AG, Shaffhausen (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,726

(22) PCT Filed: Jun. 3, 1998

(86) PCT No.: PCT/IB98/00856

§ 371 (c)(1),
(2), (4) Date: Jan. 11, 2000

(87) PCT Pub. No.: WO98/55818

PCT Pub. Date: Dec. 10, 1998

(30) Foreign Application Priority Data

Jun. 5, 1997 (RU) ..... 97108513

(51) Int. Cl.[7] ..... F41A 5/18

(52) U.S. Cl. ..... 89/191.01; 89/193; 89/140; 42/111

(58) Field of Search ..... 89/191.01, 193, 89/140, 129.01, 131; 42/100, 111

(56) References Cited

U.S. PATENT DOCUMENTS

| | | | | |
|---|---|---|---|---|
| 5,834,678 A | * | 11/1998 | Kalb | 89/191.01 |
| 5,945,626 A | * | 8/1999 | Robbins | 89/193 |

FOREIGN PATENT DOCUMENTS

| | | | | |
|---|---|---|---|---|
| DK | 58697 | * | 5/1941 | 89/191.01 |
| EP | 54088 | * | 6/1982 | 89/191.01 |
| FR | 977190 | * | 3/1951 | 89/191.01 |

* cited by examiner

*Primary Examiner*—Stephen M. Johnson
(74) *Attorney, Agent, or Firm*—Ladas & Parry

(57) ABSTRACT

An automatic weapon has a housing 1 with a movable spring-mounted barrel assembly 6 having a barrel 7 and a receiver 8. The receiver 8 has a spring-mounted bolt support 24 with a bolt 27, a buffer mechanism 32 and a firing pin mechanism 33 having a movable firing hammer 36 which interacts with the bolt support 24. The housing 1 has a trigger mechanism 50 with a firing trigger 52, a sear 43 with a spring-mounted pawl 18 interacting with the trigger 52 and the firing hammer 36, and a movable tripper 53 with cams (56, 67) interacting with the spring-mounted pawl 48 and the trigger 52. A device angularly displaces the barrel assembly 6 relative to the housing 1 and a muzzle attachment device 13 has expanding chambers with intercrossing cavities.

24 Claims, 12 Drawing Sheets

AUTOMATIC WEAPON

BACKGROUND OF THE INVENTION

The invention relates to firearms, in particular to designs of automatic small arms. 5.45 mm Kalashnikov assault rifle is known (see V. I. Murakhovsky, E. A. Slutskly. "Special Purpose Weapons" Moscow 1995 p.44).

The assault rifle can fire by single shots or continuously; the burst length is determined by the shooter.

The assault rifle features the following shortcomings:

low effectiveness of fire because of high bullet dispersion.

High bullet dispersion is the result of the following factors:

- the recoil pulse after each slot is transferred to the shooter via the receiver and the butt thus displacing the "shooter-weapon" system in space. In this process the assault rifle moves backward and sidewise dispersing the bullet trajectory;
- parts of the assault rifle (the bolt, the bolt support) which move within the receiver and impact the receiver walls in the forward and backward positions create continuous disturbances which change the position of the weapon in space;
- when the rate of continuous fire is low the "shooter-weapon" system travels considerably which increases bullet dispersion.

The shooter who determines the number of shots in the burst by himself can make from 2 to 5 shots in the burst. Due to large deflection of the assault rifle between the shots the bullets of last shots (3, 4, 5) fly far aside from the target and reduce the efficiency of the weapon.

The rate of fire of the assault rifle described in not high enough because of low coefficient of counter floor restoration under hard impact of moving parts against the butt plate.

Also a Czech heavy machine gun ZB-53 is known ("Materiel of Small Arms, Book Two, Edited by A. A. Blagonravov", OBORONGIZ NKAP, Moscow 1946, pp.374–395
(Prototype).

The machinegun relates to the types of automatic weapon with removal of powder gases. In ZB-53 machinegun the coupled barrel and receiver are shock-proof and in the process of firing they recoil backward compressing the return spring. The lock comprises the bolt and the bolt support with a retracting mechanism and a buffer device.

The trigger mechanism allows for single shot and continuous fire. The cartridges are fed from a metal hinged belt by a feed arm.

The machinegun has two rates of fire which can be changed by a gas-removing regulator and switching on and off of the buffer device of the bolt support.

The gas-removing engine comprises a gas tube support with a gas chamber, gas-removing regulator, gas escape hole in the walls of the barrel, radiator and connection pipe.

In the firing pin mechanism the role of the firing hammer is performed by the lug of the bolt support interacting with the firing pin.

Shortcoming of ZB-53 machine gun:

1. large weight;
2. low effectiveness of fire.

The reasons of low effectiveness of fire are the same as for AK-74 assault rifle and similar weapon in which the recoil pulse and the co-impact of moving parts after each shot are transferred to the shooter or to the carrier which results in deflection of the weapon sidewise from the target after each shot and in bullet dispersion.

Besides, the machinegun cannot fire by short bursts of 2–3 shots, and at the 4-th and each next shot in the burst the weapon deflects sidewise from the target and disperses the bullet trajectory.

SUMMARY OF THE INVENTION

The object of the claimed invention is to solve the problem of dispersion reduction when firing by bursts. The problem can be solved by special design of the trigger and firing mechanism which provides changeable rate of burst fire as well as by introduction of a device of angular displacement of the barrel assembly relatively the housing which results in reduction of deflection of the weapon in space in the process of firing.

The essence of the invention is expressed in the following combination of essential features enough to gain the technical results provided by the invention.

The automatic weapon comprises a barrel assembly spring-mounted in the housing with the possibility of movement, a gas-removing engine, a bolt support with the bolt, a buffer mechanism, a feeding mechanism, a device to feed the cartridges into the cartridge chamber, a firing pin mechanism and a trigger mechanism.

The claimed invention differs from the nearest prototype in the following features:

- the firing pin mechanism has a firing hammer which can move along the axle of the weapon and which is installed in the receiver in such a way that it can interact with the bolt support;
- the trigger mechanism is made in the form of a firing trigger, a tripper with cam plates and a sear with a pawl; the firing trigger is made in such a way that it can interact with the tripper;
- the tripper is installed in the housing and can move;
- the cam plates of the tripper are designed to interact with the spring-mounted sear pawl which can interact with the firing hammer.

Besides, the automatic weapon is equipped with a device of angular displacement of the barrel assembly relatively the housing.

The device of angular displacement is made in the form of a guiding element and a support base interacting with the guiding element; the support base can be installed on the housing or on the barrel assembly and the guiding element can be installed on the barrel assembly or on the housing respectively.

Along with this the feeding mechanism is made in the form of a magazine placed on the housing.

The device of feeding cartridges into the cartridge chamber comprises an intermediate chamber and a follower kinematically connected with the bolt support.

The intermediate chamber is made in the receiver stationary or formed by the walls of the receiver and the housing.

The barrel in the area of the gas remover is made in the form of at least one blind slot between the layers of the barrel and gas-escape holes connecting the blind slot with the bore and the chamber of the gas-removing engine.

The bolt support has a slotted plate which projects beyond the back end; the firing hammer is made with a cam surface for interaction with the sear and features a lug.

The tripper is installed in such a way that it can turn on the axle located along the weapon.

The tripper is installed in such a way that it can reciprocate along its turning axle; it is connected with the selector lever and in the housing there is a slot with a fixing recess for the selector lever.

The buffer mechanism is equipped with a stop; in the bolt support there is a hole for the stop; the length of the stop equals to the maximum distance between the supporting surfaces of the bolt and the bolt support.

The muzzle attachment device features a bullet hole, an expanding and a releasing chambers.

The muzzle attachment device is equipped with a second expanding chamber. The cavities of the expanding chambers can be made intercrossed with opposite eccentricity relative to the bullet hole.

The cavities of expanding chambers are made with displacement against each other in the transversal and longitudinal directions and relative to the bullet hole.

The sighting system comprises a travelling front sight and a backsight.

The backsight has two vertical seats for light elements, and the front sight has one horizontal seat.

The backsight is made in the form of a lobed disk with sighting holes.

The sighting system comprises the base of the optical sight.

The housing is made of plastic and the base of the optical sight serves as reinforcing element and is made with longitudinal guiding slots for reciprocal lugs of the receiver.

The essence of the invention is illustrated by the drawings, where

DESCRIPTION OF THE EMBODIMENTS

Figure 1:
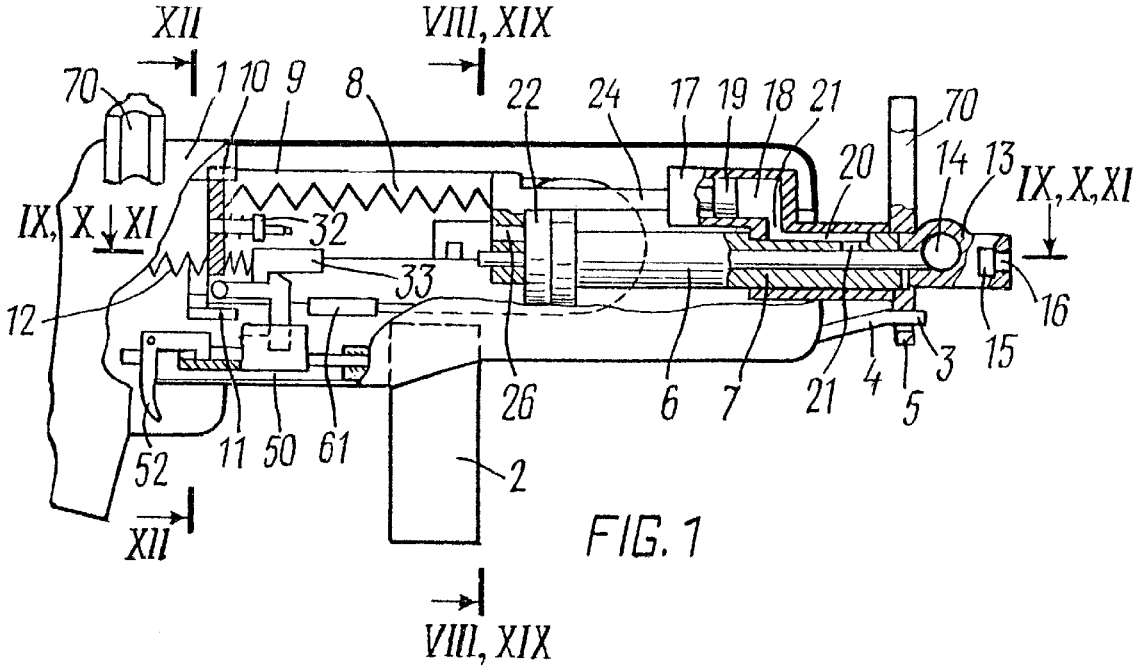
FIG. 1 shows general view of the automatic weapon.
Figure 2:
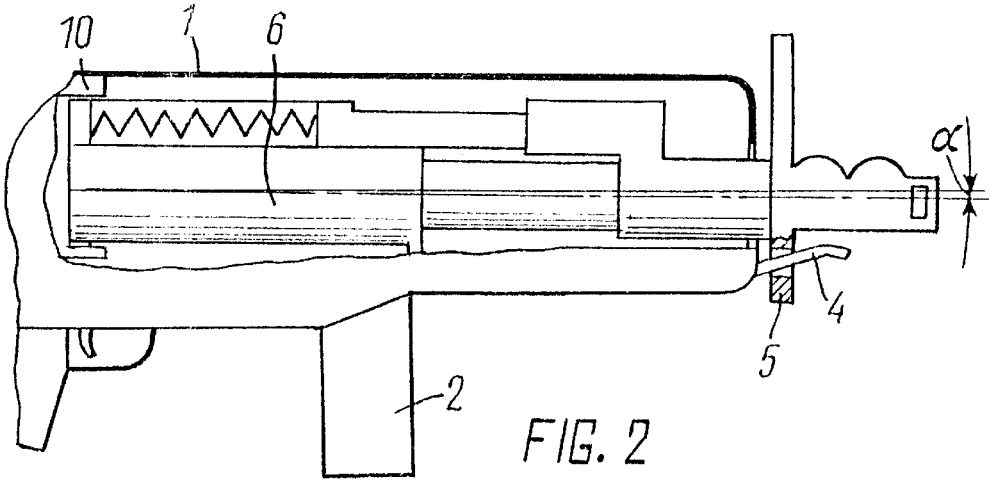
FIG. 2 shows the automatic weapon with the barrel assembly in the extreme far position.
Figure 3:
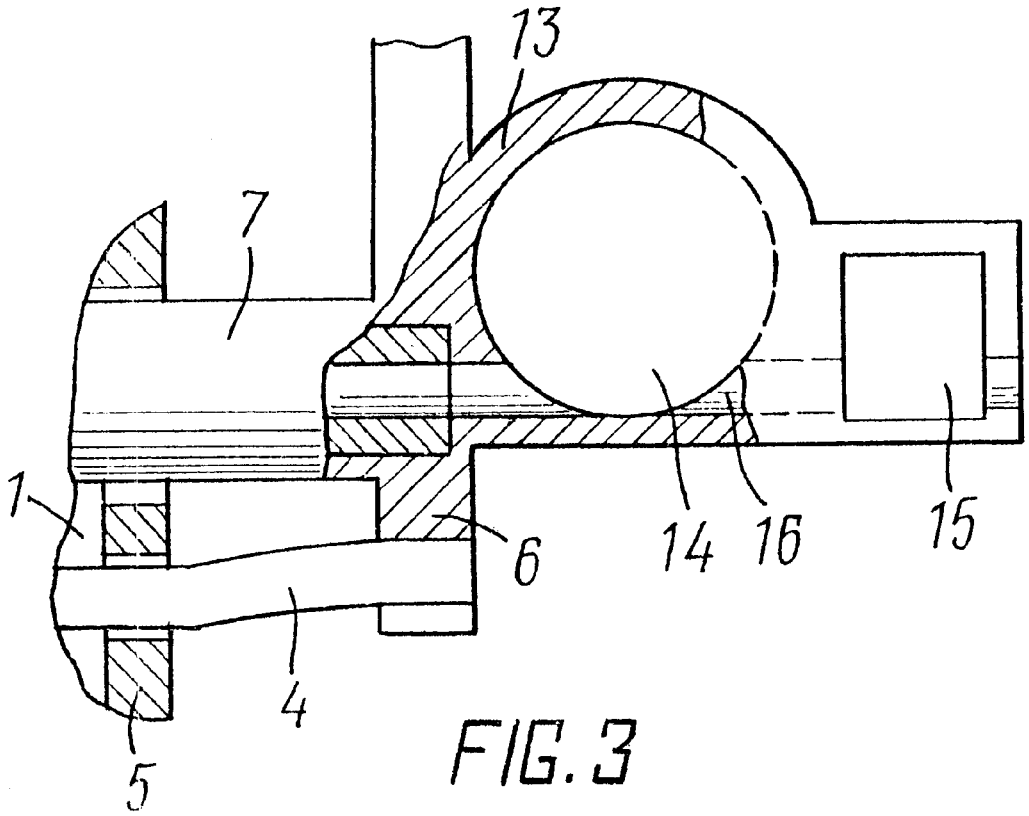
FIG. 3 shows the muzzle attachment device and the device of angular displacement.
Figure 4:
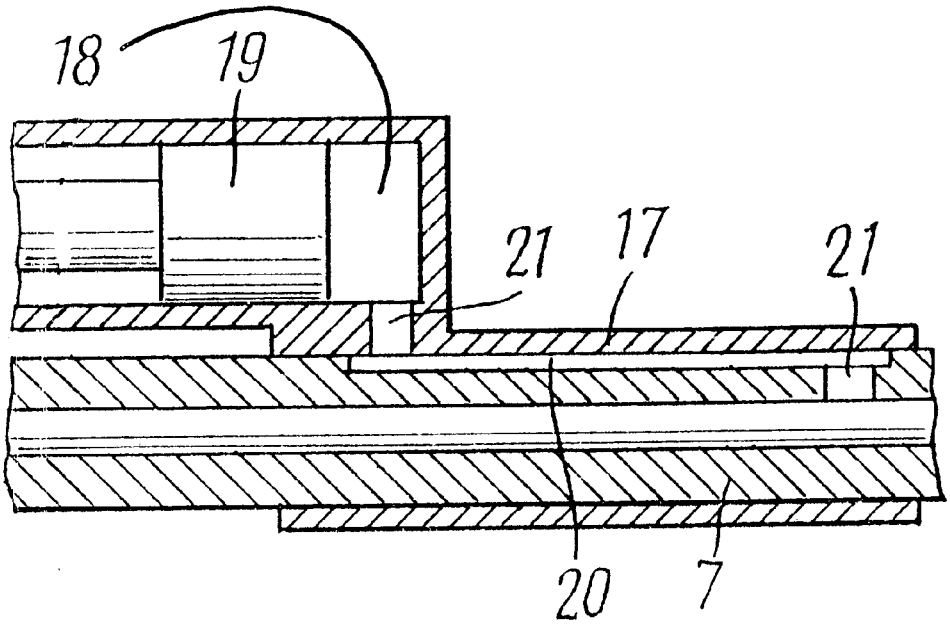
FIG. 4 shows the gas-removing engine.
Figure 5:
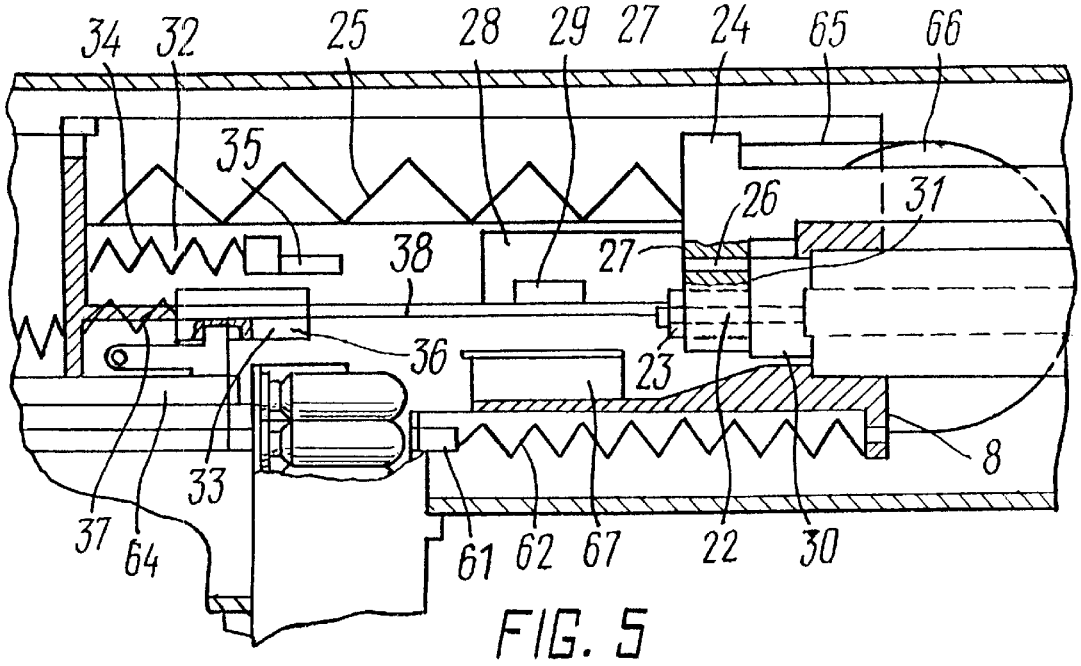
FIG. 5 shows the automatic weapon, the bolt and bolt support position before the shot.
Figure 6:
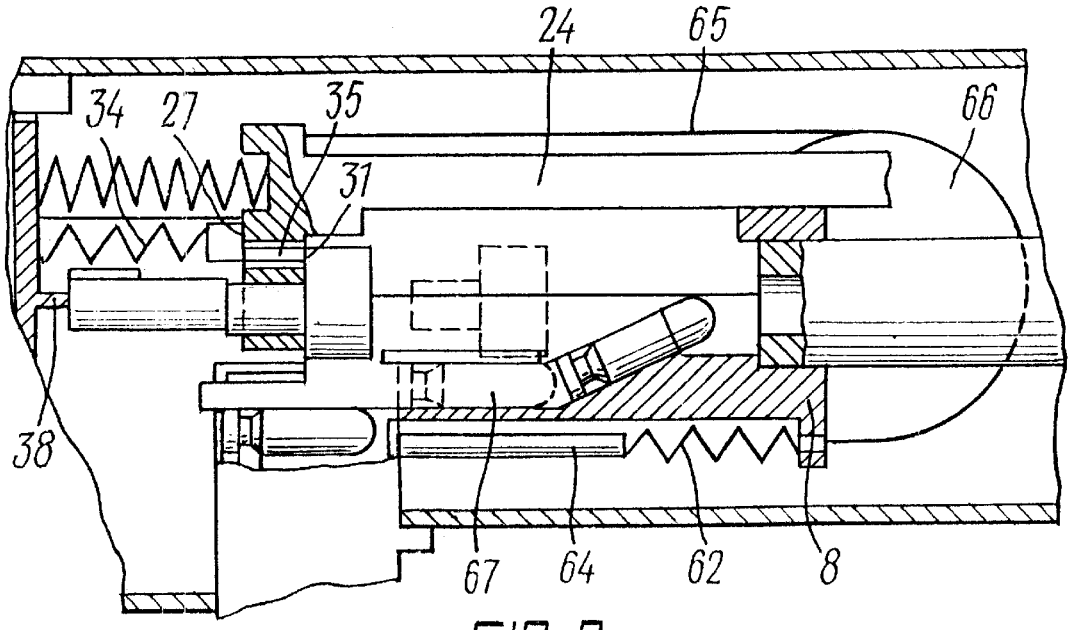
FIG. 6 shows the automatic weapon, the bolt and bolt support in backward position.
Figure 7:
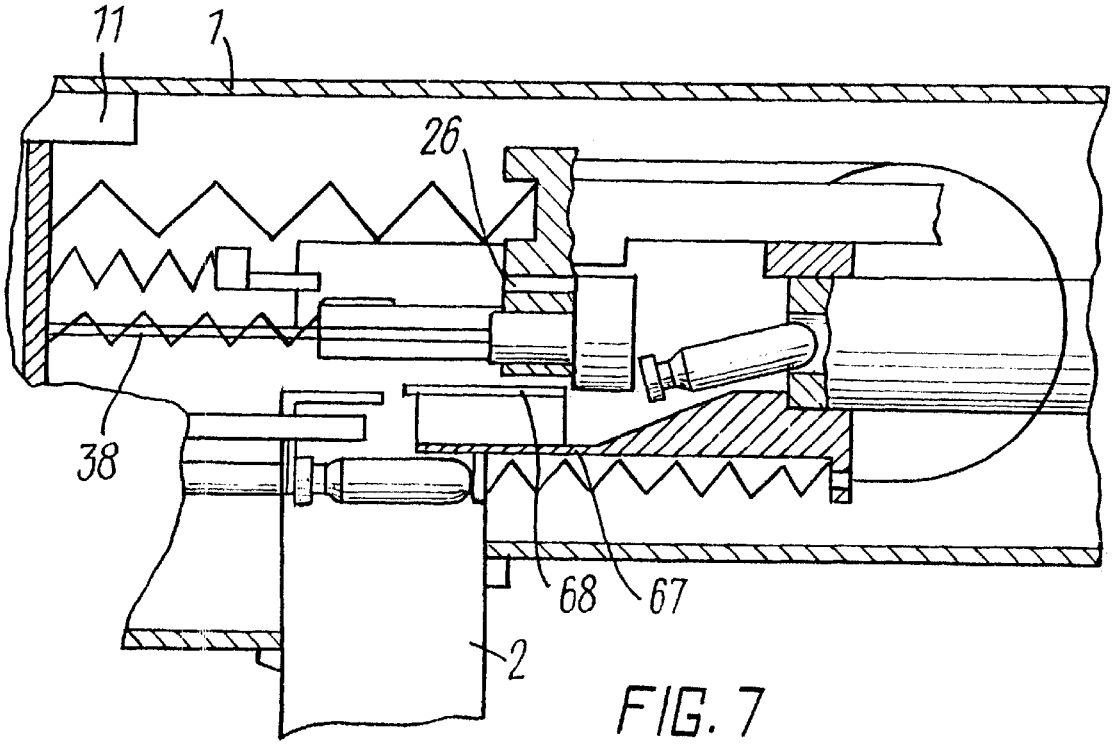
FIG. 7 shows the automatic weapon, position of the component parts when the bolt is moving forward.
Figure 8:
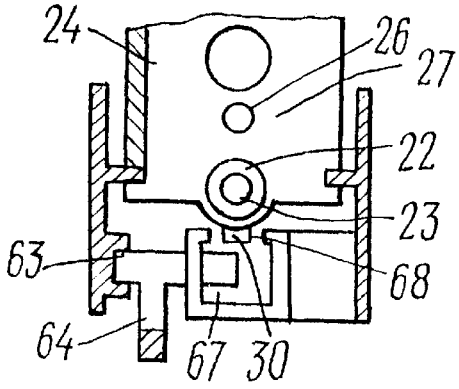
FIG. 8 shows A—A cross-section.
Figure 9:
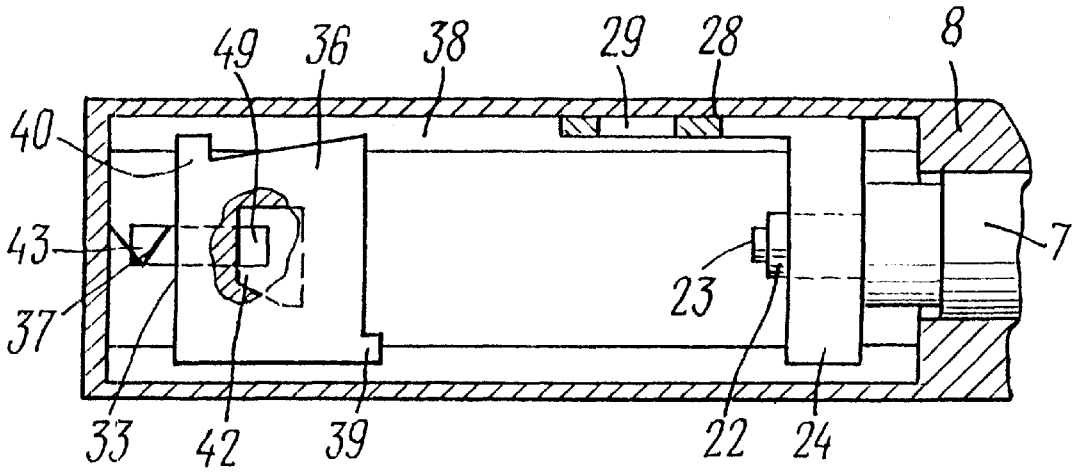
FIG. 9 shows B—B cross-section.
Figure 10:
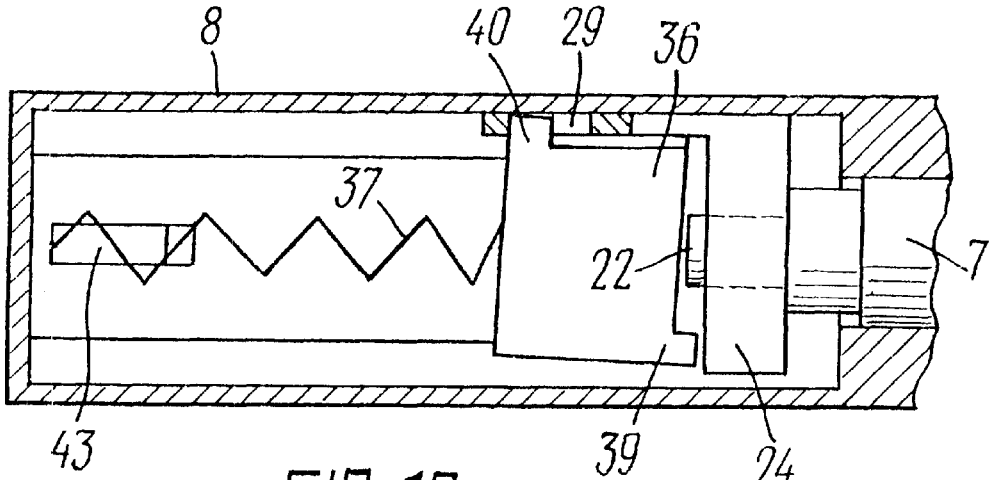
FIG. 10 shows B—B cross-section, the firing hammer and the bolt support in the forward position.
Figure 11:
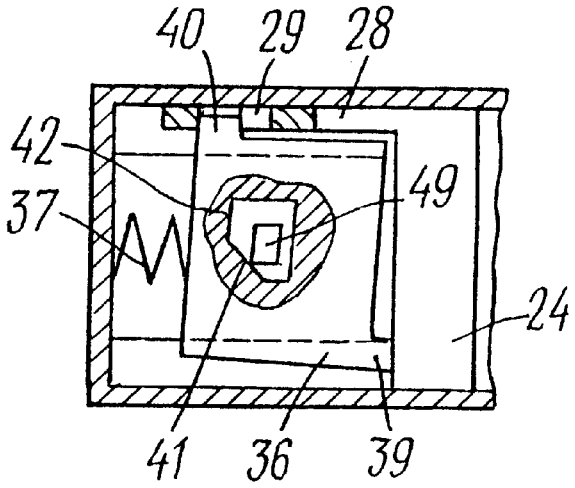
FIG. 11 shows B—B cross-section, the firing hammer and the bolt support in the backward position.
Figure 12:
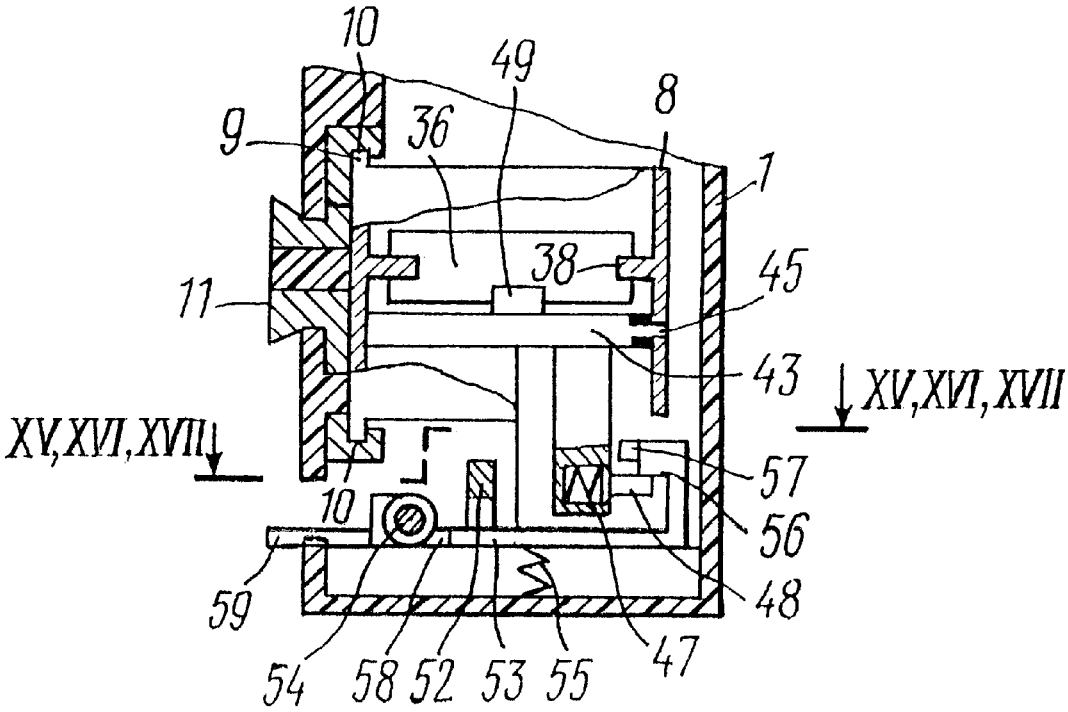
FIG. 12 shows B—B cross-section.
Figure 13:
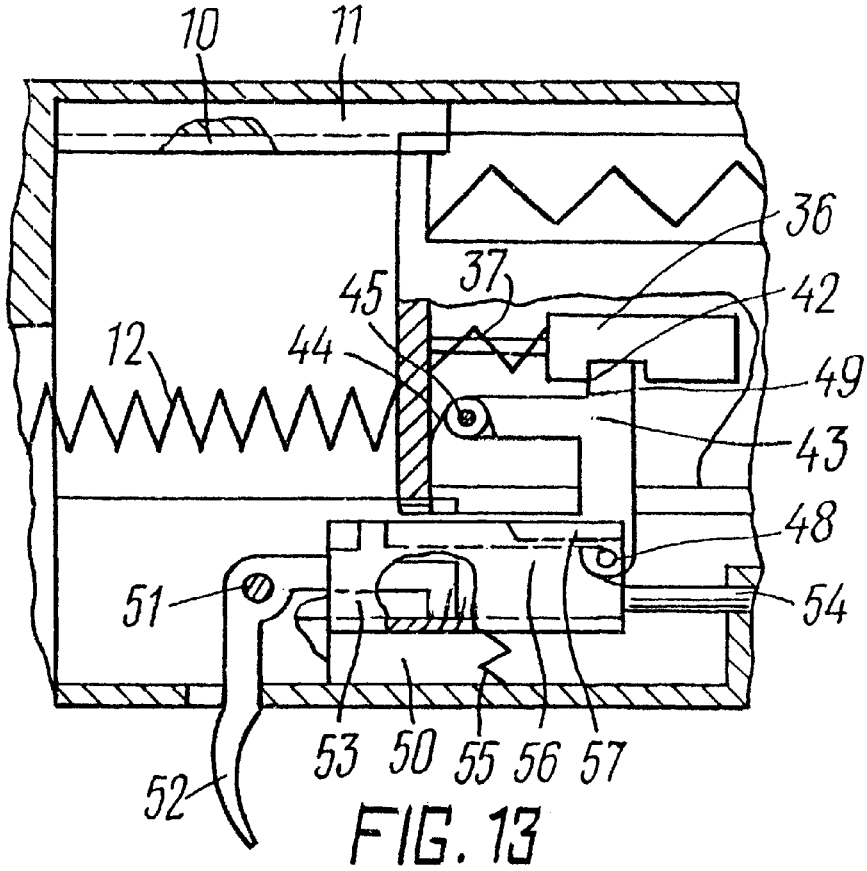
FIG. 13 shows the trigger mechanism of the automatic weapon, the firing hammer is cocked.
Figure 14:
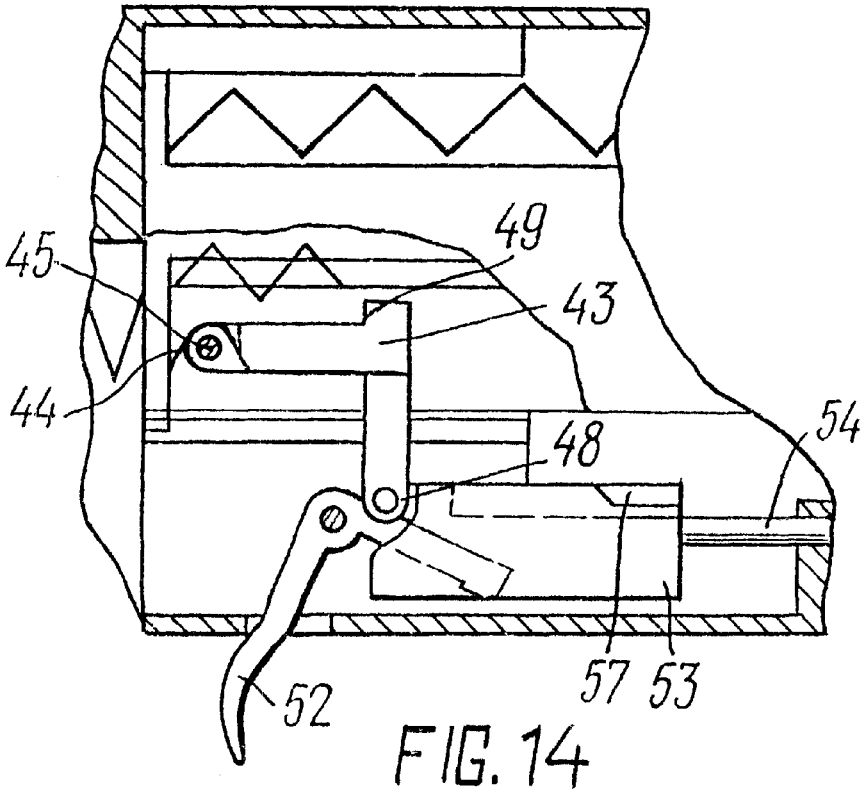
FIG. 14 shows the trigger mechanism of the automatic weapon, the firing trigger is pressed.
Figure 15:
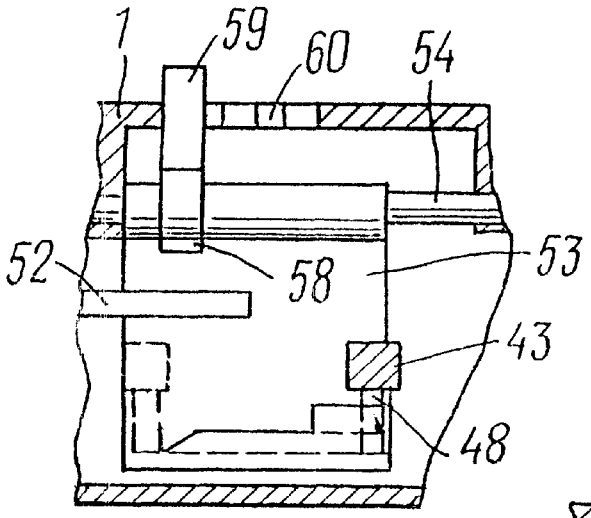
FIG. 15 shows Γ—Γ cross-section, the selector lever in the position for continuous fire. high rate of fire.
Figure 17:
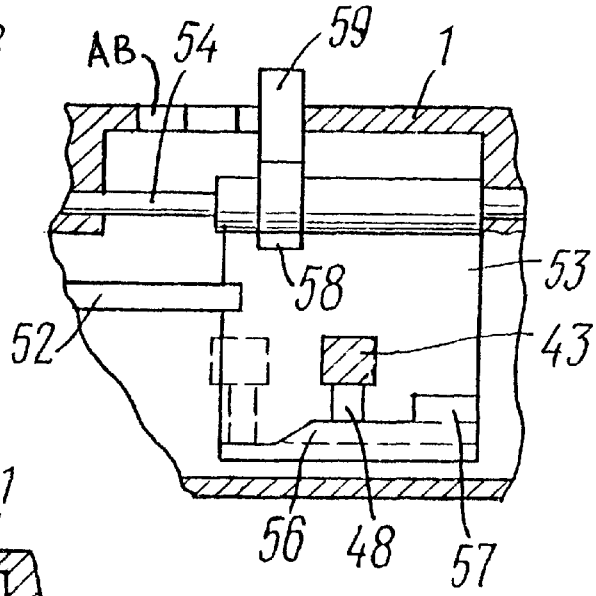
FIG. 17 shows Γ—Γ cross-section, the selector lever in the position for single shot fire.
Figure 16:
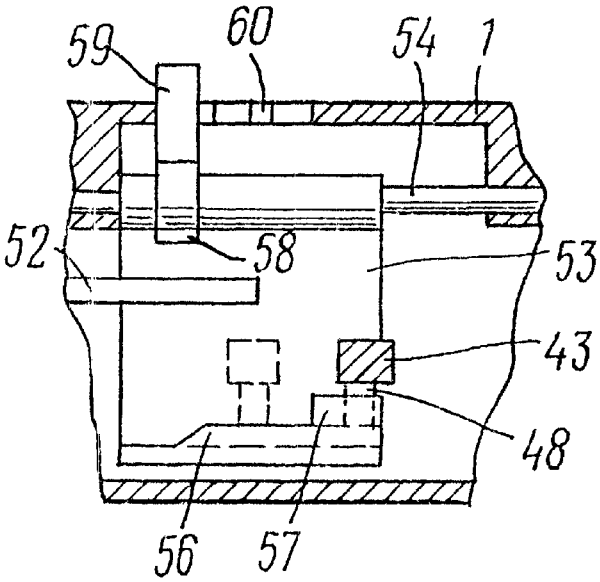
FIG. 16 shows Γ—Γ cross section, the selector lever in the position for continuous fire, low rate of fire.
Figure 18:
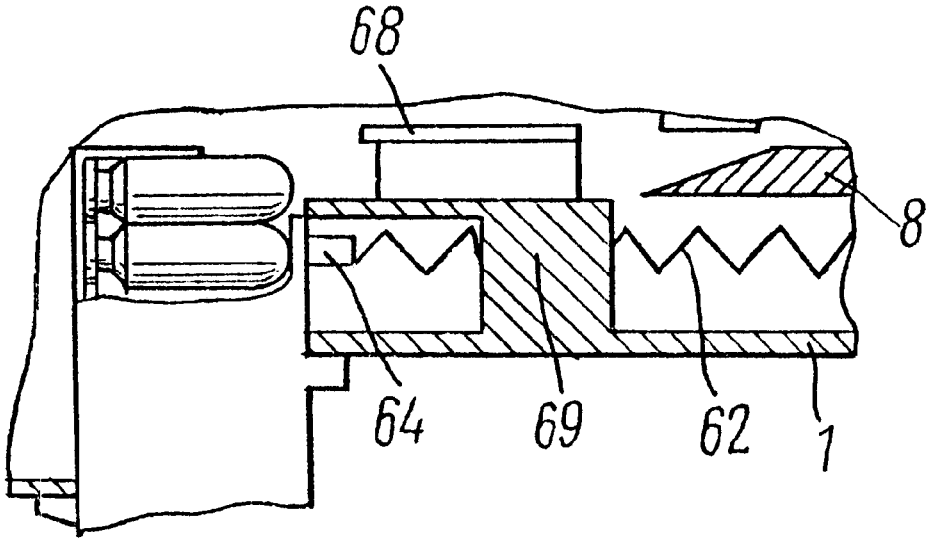
FIG. 18 shows the automatic weapon, position of the component parts before the shot, the cartridge chamber is formed by the walls of the receiver and the housing.
Figure 19:
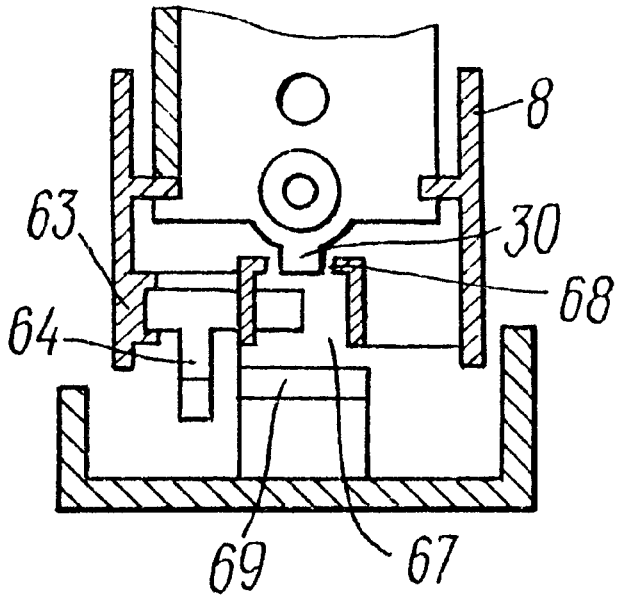
FIG. 19 shows A—A cross-section, the cartridge chamber is formed by the walls of the receiver and the housing.
Figure 20:
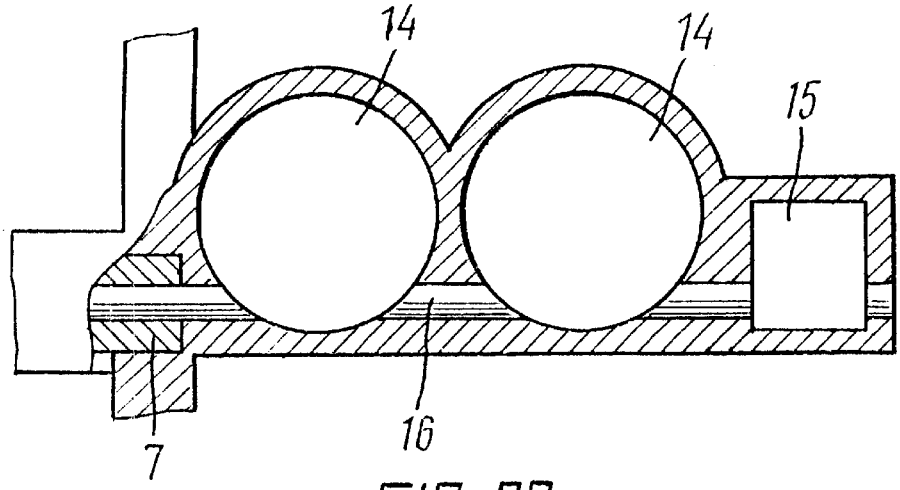
FIG. 20 shows the muzzle attachment device with the second expanding chamber.
Figure 21:
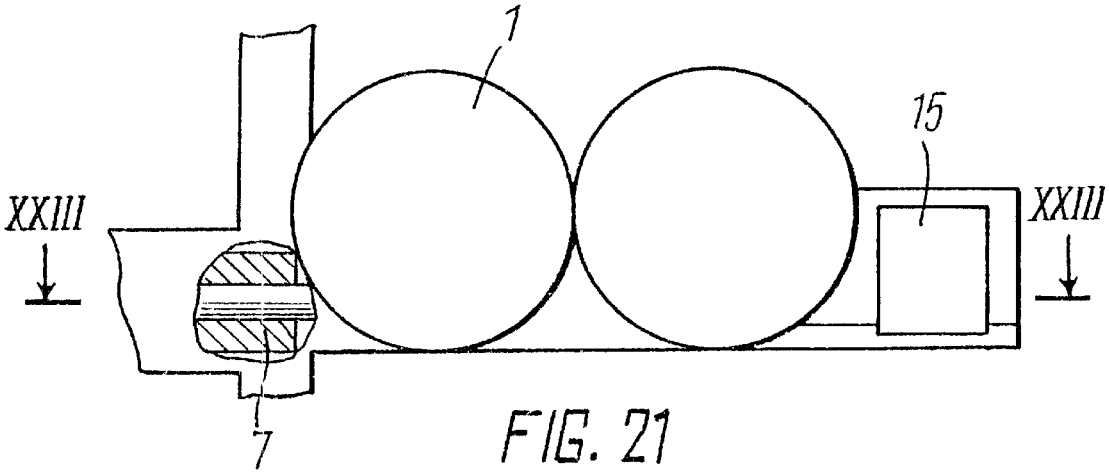
FIG. 21 shows the muzzle attachment device made with displacement of the expanding chambers relatively each other in transverse and longitudinal directions.
Figure 22:
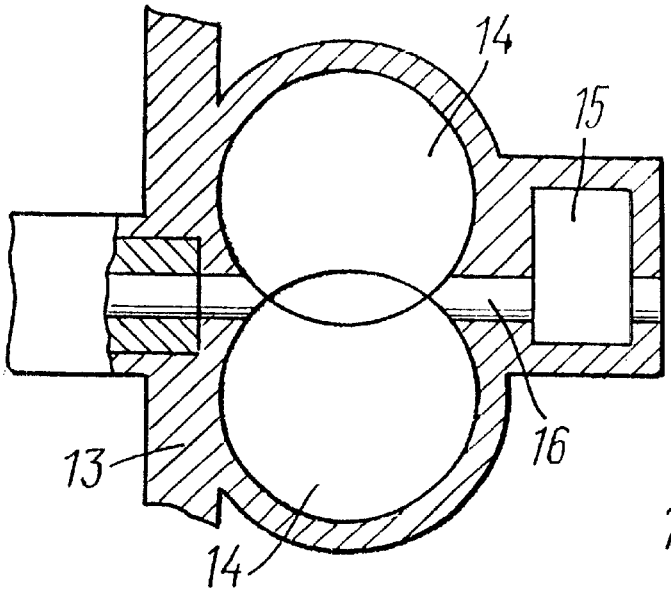
FIG. 22 shows the muzzle attachment device with expanding chambers made with opposite eccentricity.
Figure 24:
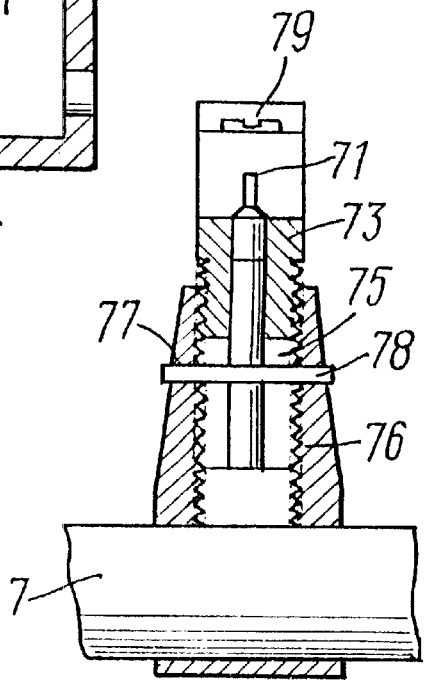
FIG. 24 shows the travelling front sight.
Figure 23:
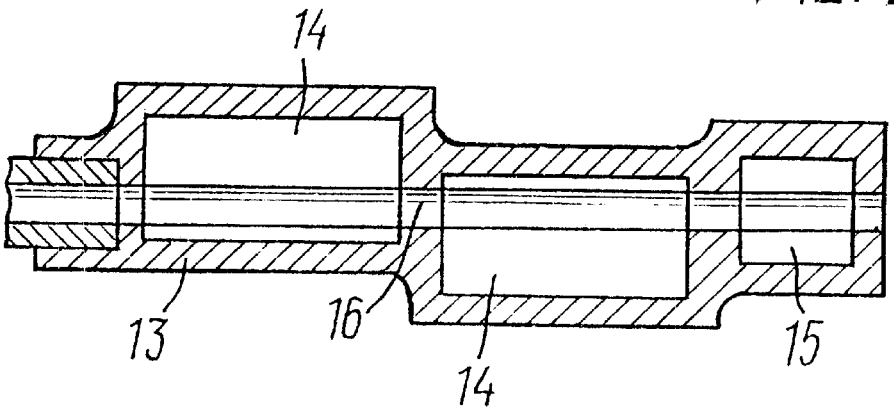
FIG. 23 shows D—D cross-section, the muzzle attachment device made with displacement of the expanding chambers against each other in transverse and longitudinal directions.
Figure 25:
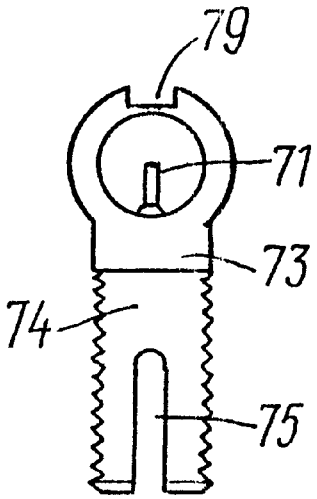
FIG. 25 shows the front sight case.
Figure 26:
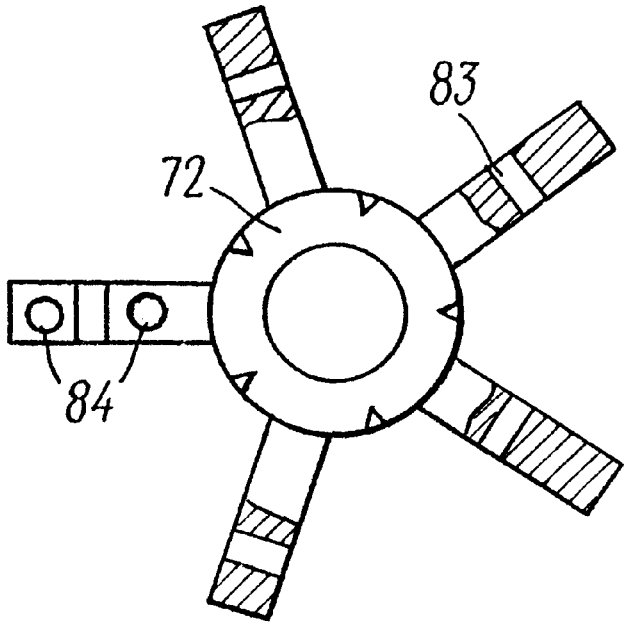
FIG. 26 shows the lobed disk.
Figure 27:
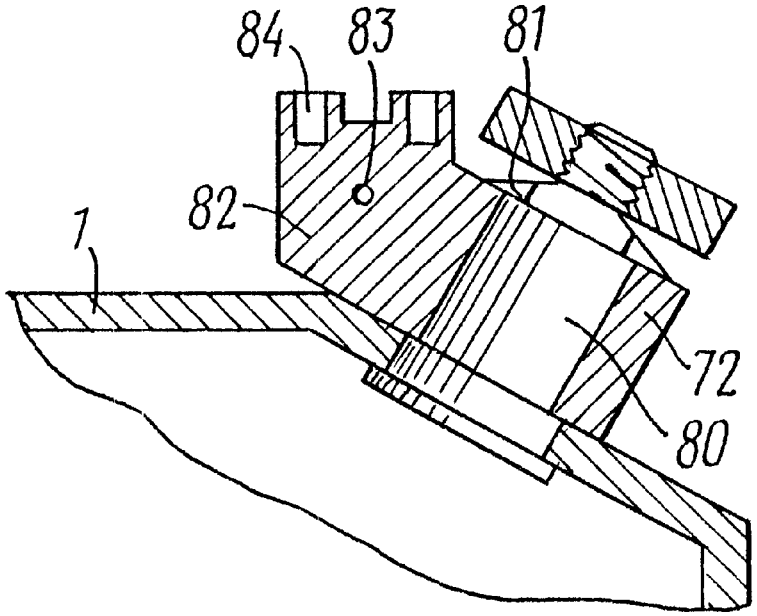
FIG. 27 shows the backsight or the housing.

The automatic weapon comprises a housing 1 made of metal or plastic, a feeding mechanism in the form of a magazine 2 fixed on the housing 1, a device of angular displacement 3 of the barrel assembly 6 consisting of a guiding element 4 and a support base 5. The guiding element 4 is installed on the housing 1 (FIG. 1) or on the barrel assembly 6 (FIG. 3) and the support base 5 is installed on the barrel assembly 6 or on the housing 1.

In the housing 1 the barrel assembly 6 is placed which comprises the barrel 7 and the receiver 8. The barrel assembly 6 can reciprocate leaning by lugs 9 of the receiver 8 against the longitudinal guiding slots 10 of the optical sight base 11; in this process the support base 5 moves along the guiding element 4. The barrel assembly 6 is spring-mounted on a return spring 12. In the muzzle section of the barrel 7 a muzzle attachment device 13 is installed with an expanding chamber 14, a releasing chamber 15, a bullet hole 16. On the top of the barrel a gas-removing engine 17 is installed which comprises a gas chamber 18, a piston 19, a gas remover 20 and gas-escape holes 21. In the receiver 8 a travelling bolt 22 with a firing pin 23 and a bolt support 24 with a return spring 25 are installed.

The bolt support 24 is connected with the piston 19 and has a hole 26 and a support surface 27. On the bolt support 24 the plate 28 is fixed stiffly which projects beyond the back end of the bolt support 24 and has a slot 29. On the bolt 22 there is a ramming lug 30 and a support surface 31. Inside the receiver 8 near the back end there are a buffer mechanism 32 and a firing pin mechanism 33. The buffer mechanism comprises the buffer spring 34 and the stop 35. The length of the stop 35 is equal to the distance between the support surfaces 27 and 31.

The firing pin mechanism 33 comprises a travelling firing hammer 36 with a firing spring 37. The firing hammer 35 is mounted on guide lugs 38 of the receiver 1 and has a front 39 and a back 40 lugs, a cam surface 41 and a sear notch 42.

The sear 43 is made in the form of a single-arm lever mounted on the spring 44. One end of the lever is placed on the axle 45, the other end is equipped with a pawl 48 mounted on the spring 47. The sear 43 has a shoulder 49.

The trigger mechanism 50 comprises the axle 51 of the firing trigger, the firing trigger 52 which permanently interacts with the tripper 53. The tripper 53 can reciprocate and turn about the longitudinal axle 54; it is also spring-mounted on spring 55 and equipped with a long cam 56, a short cam 57, cam surfaces of which are displaced against each other.

On the longitudinal axle 54 in the slot 58 a selector lever 59 is installed which projects outside through the shaped slot 60 in the housing 1. In the shaped slot 60 there are fixing recesses to fix the selector lever 59.

Position of the selector lever 59:

in the first recess—corresponds to single shot fire;

in the second recess—corresponds to 2-shot burst fire;

in the third recess (AB) corresponds to continuous fire.

The automatic weapon is equipped with the device 61 of feeding cartridges into the cartridge chamber which comprises a spring 62, a follower 64 travelling on guides 63 and connected kinematically, for example by flexible connection 65 via a roll 66 with the bolt support 24, an intermediate chamber 67 with a slot 68 for the ramming lug 29.

The intermediate chamber 67 can be formed by the walls of the receiver 8 as well as by the wall 69 of the housing 1.

On the housing 1 a sighting system 70 is installed comprising a travelling front sight 71, a backsight 72 and a base of the optical sight 11 with longitudinal guide slots 10.

The front sight 71 comprises a case 73 with a threaded part 74. In the case of the front sight there are slots 75. The front sight 71 is screwed into the front sight base 76. In the base 76 there are holes 77 for the fixing pin 78. On the front sight case 73 there is a horizontal seat 79 for a light element.

In the back part of the housing 1 on the tapered surface an axle 80 is installed stationary; on the axle 80 the backsight 72 rotates with the possibility to fix certain positions by the fixing arm 81. The backsight is made in the form of a turning lobed disk with lobes 82. In the lobes there are holes 83 of different diameters which serve as diopters. On the top of one of the lobes there are two vertical seats 84 for light elements.

On the automatic weapon a muzzle attachment device 13 of several designs can be installed.

The device with one muzzle attachment expanding chamber 14 and a releasing chamber 15 has been mentioned at the beginning of the description.

There is another variant of the muzzle attachment device with a second expanding chamber 14 with non-intercrossing cavities of the first and the second chambers, a releasing chamber 15 and a bullet hole 16; note that the releasing chamber 15 intersects the bullet hole 16.

Another variant of the muzzle attachment device 13 comprises two expanding chambers 14 the cavities of which are displaced against each other in the transverse direction relative to the bore.

The claimed weapon operates as follows.

By turning the backsight 72 the lobe 82 with the required diopter is fixed. To load the weapon the bolt support 24 is drawn backward; when moving backward it pulls the follower 64 forward via the flexible connection 65, and the follower 64 withdraws the upper cartridge from the magazine into the intermediate chamber 67 and places it in front of the bolt 22. The sear notch 42 of the firing hammer 36 is placed behind the shoulder 49 of the sear 43.

The bolt support 24 under effect of the return spring 25 moves forward, the bolt 22 seizes the withdrawn bullet by the ramming lug 30, travels along the slot 68 of the cartridge chamber 67 and rams the cartridge in the cartridge chamber of the barrel 7.

The bolt support 24 interacts with the bolt 22 and the bore is locked.

The follower 64 returns to the initial position under effect of the spring 62.

The firing hammer 36 is engaged by the shoulder 49 on the sear notch 42 of the sear 43.

The weapon is ready to fire.

Automatic continuous fire.

For automatic continuous fire the selector lever 59 is placed into the recess AB of the shaped slot 60. When doing this it transfers the tripper 53 backward.

The tripper 53 is installed in such a way that the pawl 48 is placed under the long cam 56 and under the short cam 57 but in direct contact with only the long cam 56.

When the firing trigger 52 is pressed it turns the tripper 53 on the longitudinal axle 54 and affects the pawl 48 and the sear 42 by the long cam 56.

The sear 42 turns, the shoulder 49 is released from engagement with the sear notch 42 of the firing hammer 36 thus releasing it.

When the firing trigger 52 is pressed it turns the tripper 53 on the longitudinal axle 54 and affects the pawl 48 and the sear 42 by the long cam 56.

The sear 42 turns the shoulder 49 is released from engagement with the sear notch 52 of the firing hammer 36 thus releasing it.

The firing hammer 36 under action of the firing spring 37 travels ahead and strikes the firing pin 23; the first shot occurs.

After the shot the bullet travels along the bore 7 and passes the gas-escape hole 21; the powder gases expand and through the gas-escape hole 21, gas-remover 20 and another gas escape hole 21 they enter the gas chamber 18 and move the pin 19 with the bolt support 24 and the firing hammer 36 backward. The back lug 40 of the firing hammer 36 fits into the slot 29 of the bolt support 24 and engages it; simultaneously the bore is unlocked, the bolt 22 removes the cartridge case. The cartridge case meets the deflector on the receiver 8 and is extracted from the weapon.

In the extreme back position the bolt support 24 and the bolt 22 interact the buffer mechanism 32 simultaneously.

The bolt support 24 impacts the thick part of the stop 35 by its support surface 27, and the bolt 22 by its support surface 31 impacts the end of the stop 35 passing through the hole 26.

Note that to insure simultaneous interaction the length of the stop 35 is equal to the distance between the surfaces 31 and 26 of the bolt 22 and the bolt support 24 interacting with the stop 35.

After the impact in the backward position the bolt support 24 engaged with the firing hammer and the bolt 22 returns forward under effect of the return spring 25 and the firing spring 37; the second shot is made.

The cartridge is rammed into the cartridge chamber in the same manner as during manual reloading.

The barrel assembly 2 under effect of blow-back forces resulted from the first shot recoils backward along the guiding slots 10 and the guiding element 4 thus compressing the return spring 12.

After the shot the weapon is displaced in space which is caused by dynamic moments generated because of non-coincidence of the centres of mass of the elements inside the barrel assembly 6 and the direction of blow-back as well as because of displacement of the centre of mass of the weapon when the barrel assembly 6 blows back.

As the barrel assembly 6 has the possibility of angular displacement relative to the housing 1, when the barrel assembly 6 moves by its support base 5 along the guiding element 4 it turns to the angle determined by the cam profile of the guiding element 4. In this process through the guiding element 4 a force opposite to the direction of displacement of the barrel assembly 6 affects the housing 1 which results in displacement of the housing 1. The barrel assembly 6 turns in the guiding slots 10, the housing tends to turn relative to the point determined by the method of retaining the weapon.

Because of difference in reduced masses, moments of inertia and the points of rotation the angles of turning of the barrel assembly 6 and the housing 1 are incomparably different.

The difference of the complementary angle of turning determines the value of compensation of the weapon deflection in space.

Changing the position, the angles of tilt, the profile of the guiding element we can change the value of the angle of turning of the barrel assembly 6 and by this way adjust the area and the tilt angle of the bullet dispersion ellipse. In this way the best results can be gained which will ensure the highest possible hit probability.

Having got a pulse from the second shot the barrel assembly 6 continues and the bolt support 24 with the firing hammer 36 starts travelling backward; the sear 43 is still engaged by the long cam 56 and the tripper 53 on the pawl 48.

At the end of the barrel assembly 6 recoil after the second shot the pawl 48 leaves the long cam 56 and rises together with the sear 43 under effect of the spring 44.

During counter floor the firing hammer 36 interacts by the cam surface 41 with the shoulder 49 on the sear 43, releases the lug 40 out of the slot 29 in the plate 28 of the bolt support 24 and stops by the sear notch 42 on the shoulder 49.

The bolt support 24 with the bolt 22 finishes ramming of the cartridge into the cartridge chamber.

The barrel assembly 6 after the second shot moves forward under effect of the spring 12.

Automatic fire changes from high rate to low rate.

The pawl 48 travelling ahead together with the barrel assembly 6 interacts with the short cam 57 of the tripper 53 and turns the sear 43.

The firing hammer 36 is released from its engagement with the sear 43 and strikes the firing pin 23; the third shot takes place.

The barrel assembly 6 starts moving backward, the pawl 48 is released from its engagement with the short cam 57 and rises together with the sear 43 under effect of the spring 44.

The bolt support 24 with the bolt 22 recoil, too.

At the beginning of counter floor of the bolt support 24 in the forward position the firing hammer 36 stops on the sear 43. At the beginning of counter floor of the bolt support 24 in the forward position the firing hammer 36 stops on the sear 43.

After the second shot the pawl 48 interacts only with the short cam 57 and under effect of the spring 47 contacts the side surface of the long cam 56. The short length of the short cam 57 is the cause of that the pawl 48 stops interacting with it and rises together with the sear 43 at the beginning of recoil of the barrel assembly 6 till the moment when the bolt support 24 with the firing hammer recoils to the backward position. That's why at the beginning of counter floor of the bolt support 24 the firing hammer 36 stops on the sear 43 in the backward position. There is some time of "waiting" before the firing hammer 36 is released from engagement with the sear 43; it takes some time for the barrel assembly 6 to recoil backward after the previous shot and then, moving ahead due to interaction of the pawl 48 with the short cam 57 will lead to turning of the sear 43 and release of the firing hammer 36. It results in increase of intervals between the shots, and the rate of fire after the second shot becomes low.

The cycles are repeated.

Thus the weapon can fire all the time while the firing trigger 51 is pressed. When it is released the tripper will turn under effect of the spring 55, the pawl 48 with the sear 43 will rise, the firing hammer 35 will stop on the sear 43 and the weapon will stop firing. To continue fire one should press the firing trigger 51 again, two shots will be fired at high rate and low rate fire will follow.

Continuous fire by 2 shot bursts.

For such fire the selector lever 57 is placed into the recess 2 of the shaped slot 60.

The tripper 53 is installed in such a way that the pawl 48 is placed only above the long cam 57 and is in direct contact with it.

When the firing trigger 51 is pressed the shot takes place in the same way as during the continuous fire.

The barrel assembly 6 also recoils backward, in the process of recoiling the second shot with high rate of fire takes place. After the second shot at the end of recoil of the barrel assembly 6 the pawl 48 leaves the long cam 56 and rises with the sear 43 under effect of the spring 44.

The firing hammer 36 by its sear notch stops on the shoulder 49 of the sear 43.

The bolt support 24 with the bolt 22 finishes ramming the cartridge into the cartridge chamber.

After the second shot the barrel assembly 6 travels forward under effect of the spring 12.

The pawl 48 when moving forward together with the barrel assembly 6 under effect of the spring 47 contacts the side surface of the long cam 56.

When the barrel assembly 6 is the forward position the pawl 48 does not reach the short cam 57 and the sear 43 continues to engage the firing hammer 36.

The fire stops.

To continue fire by another 2-shot burst it is necessary to release the firing trigger 51.

When the firing trigger 51 is released the tripper 53 turns under effect of the spring 55 and the pawl 48 will move under the long cam 56 under effect of the spring 47.

After that the firing trigger 51 should be pressed and 2 shots with high rate will take place.

Single shot fire

For this type of fire the selector lever 57 is placed into the recess 1 of the shaped slot 60. As the result of it the tripper 53 is moved by the selector lever 57 in the direction opposite to the direction of the barrel assembly 6 recoil. It will result in reduction of the length of the contact area of the pawl 48 and the long cam 56 to the minimum value.

The tripper 53 is installed in such a way that the pawl 48 is placed only above the long cam 57 and is in direct contact with it.

After the first shot when the barrel assembly 6 recoils backward the pawl 48 leaves the long cam lug 57, allows the sear 43 to rise upward and to engage the firing hammer 36 by the shoulder 49 on the sear 43.

The bolt support 24 and the bolt 22 ram the cartridge into the cartridge chamber under effect of the return spring 25. The barrel assembly 6 recoils backward and under effect of the return spring 12 moves to the forward position. In the forward position of the barrel assembly 6 the pawl 48 interacts with the side surface of the long cam. After the firing trigger 51 has been released the tripper 53 turns on the longitudinal axle 54 under effect of the spring 55 and the pawl 48 under effect of the spring 47 moves under the long cam 56.

Operation of the muzzle attachment device:

After the bullet has been withdrawn from the barrel 7 into the bullet hole 16 of the muzzle attachment device 13, the flow of powder gases in the form of a widening cone enters the expanding chamber 14.

Thanks to the eccentric position of the expanding chamber 14 the powder gases start rotating in the circular cavity and break the central jet.

Rotation of the gas flow prevents formation of a stable axial gas jet decelerating their ejection into the atmosphere through the releasing chamber 15, and due to an intense thermal exchange with the walls of the expanding chamber 14 rotation of the gas flow promotes reduction of gas pressure and temperature.

In the releasing chamber 15 the cooled swirled gas jet expands and interacting with the walls is ejected to the sides with a light differential pressure and temperature, and consequently with a low noise level.

Only little amount of gases enters the bullet hole 16 in the front wall of the releasing chamber 15, and consequently, almost all the pulse of gas-powder mixture will be subtracted from the pulse of the cartridge and thus the efficiency of the muzzle attachment device will be increased.

Increase of the number of expanding chambers and their reciprocal displacement result in the same effect.

Thus as compared to the prototype the claimed invention provides increase of the effectiveness of fire, i.e. increase of the number of kills at the same number of shots.

What is claimed is:

1. In an automatic weapon, the improvements comprising:

a housing 1 defining a longitudinal axis of the automatic weapon;

a barrel assembly 6 comprising a barrel 7 and a receiver 8 and being spring mounted in the housing to be movable longitudinally of the longitudinal axis;

a bolt support 24 with a bolt 22 in the receiver 8;

a firing pin mechanism 33 in the receiver 8, the firing pin mechanism having a firing hammer 36 movable longitudinally of the longitudinal axis to interact with the bolt support; and a trigger mechanism 50 having a firing trigger 52, a sear 43 provided with a spring-mounted pawl 48 for interacting with the firing trigger and the firing hammer, and a tripper 53 with cams (56, 57) for interacting with the spring-mounted pawl, the tripper being movable to interact with the firing trigger.

2. An automatic weapon comprising:

a spring-mounted barrel assembly 6 installed movably in a housing 1, said housing 1 defining together with the barrel assembly a longitudinal axes, said barrel assembly comprising a barrel 7 and a receiver 8;

a gas-removing engine 17 comprising a chamber 18 and a gas-remover 20;

a spring-mounted bolt support 24 with a bolt 27;

a buffer mechanism 32;

a feeding mechanism 2;

a device 61 for feeding cartridges to a cartridge chamber;

a firing pin mechanism 33 having a firing hammer 36 which is movable longitudinally in the receiver 8;

a trigger mechanism 50 having a firing trigger 52, a sear 43 provided with a spring-mounted pawl 48 and adapted to interact with the trigger 52 and the firing hammer 36; and a tripper 53 with cams (56, 57) designed to interact with the spring-mounted pawl 48, the tripper 53 being installed movably in the housing 1 and adapted to interact with the trigger 52.

3. An automatic weapon according to claim 2, further comprising a device 3 for angular displacement of the barrel assembly 6 relative to the housing 1.

4. An automatic weapon according to claim 3, wherein the device 3 for angular displacement of the barrel assembly 6 relative to the housing 1 comprises a guiding element 4 installed on the barrel assembly 6 and a support base 5 which is installed on the housing 1 and interacts with the guiding element 4.

5. An automatic weapon according to claim 3, wherein the device 3 for angular displacement of the barrel assembly 6 relative to the housing 1 comprises a guiding element 4 installed on the housing 1 and a support base 5 which is installed on the barrel assembly 6 and interacts with the guiding element 4.

6. An automatic weapon according to claim 2, wherein the feeding mechanism is a magazine 2 installed on the housing 1.

7. An automatic weapon according to claim 2, wherein the device 61 for feeding cartridges into the cartridge chamber comprises an intermediate chamber 67 with a longitudinal slot 68 for passage of a ramming lug 30 of the bolt 22 and a follower 64 of the cartridge, the following 64 being coupled with the bolt support 24.

8. An automatic weapon according to claim 7, wherein the intermediate chamber 67 is provided in the receiver 8.

9. An automatic weapon according to claim 7, wherein the intermediate chamber 67 is provided in the receiver 8 and the housing 1.

10. An automatic weapon according to claim 2, wherein an area of the barrel 7 adjacent to the gas removing engine 17 is made laminated, the gas remover 20 is made in the form of at least one blind slot between the layers of the barrel 7, and gas-escape holes 21 connect the blind slot with a bore of the barrel 7 and the chamber 18 of the gas-removing engine 17.

11. An automatic weapon according to claim 2, wherein:

the bolt support 24 is equipped with a plate 28 with a slot 29, the plate 28 projecting beyond the back end of the bolt support 24; and the firing hammer 36 is made with a cam surface 41 to enable interaction with the sear 43 and has a lug 40.

12. An automatic weapon according to claim 2, wherein the tripper 53 is pivotally mounted on an axle 54 longitudinal to the weapon.

13. An automatic weapon according to claim 12, wherein the tripper 53 is adapted to reciprocate along the axle 54 and is connected with a selector lever 59 and the housing 1 is provided with a slot 60 having fixing recesses for the selector lever 59.

14. An automatic weapon according to claim 2, wherein the buffer mechanism 32 is equipped with a stop 35, in the bolt support 24 that is a hole 26 for the stop 35, and the length of the stop 35 is equal to the maximum distance between support surfaces (31,27) of the bolt 22 and the bolt support 24.

15. An automatic weapon according to claim 2, further comprising a muzzle attachment device 13 with a bullet hole 16, an expanding chamber 14 and a releasing chamber 15.

16. An automatic weapon according to claim 15, wherein the muzzle attachment device is equipped with a second expanding chamber.

17. An automatic weapon according to claim 16, wherein the expanding chambers are made with intercrossing cavities and with an opposite eccentricity relative to the bullet hole 16.

18. An automatic weapon according to claim 16, wherein the expanding chambers are spaced along and shifted transversely relative to the bullet hole 16.

19. An automatic weapon according to claim 2, further comprising a sighting system 70 with a traveling front sight 71 and a backsight 72.

20. An automatic weapon according to claim 19, wherein the front sight 71 has one horizontal recess 79 and the backsight 72 has two vertical recesses 84 for light elements.

21. An automatic weapon according to claim 20, wherein the backsight 72 comprises a lobed disk with sighting holes 83.

22. An automatic weapon according to claim 21, wherein the housing 1 is made of plastic and the base of the optical sight 11 serves as a reinforcing element for the housing 1 and is made with longitudinal guiding slots 10 for reciprocal lugs 9 of the receiver 8.

23. An automatic weapon according to claim 19, wherein the backsight 72 comprises a lobed disk with sighting holes 83.

24. An automatic weapon according to claim 19, wherein the sighting system 70 comprises a base of an optical sight 11.

* * * * *